US011209172B2

(12) United States Patent
Delgado Sancho et al.

(10) Patent No.: US 11,209,172 B2
(45) Date of Patent: Dec. 28, 2021

(54) HOB DEVICE

(71) Applicant: BSH Hausgeräte GmbH, Munich (DE)

(72) Inventors: Enrique Delgado Sancho, Saragossa (ES); Esther Ondiviela Serrano, Saragossa (ES); David Paesa Garcia, Saragossa (ES); Daniel Palacios Tomas, Saragossa (ES); Annika Tuchen, Saragossa (ES)

(73) Assignee: BSH Hausgeräte GmbH, Munich (DE)

( * ) Notice: Subject to any disclaimer, the term of this patent is extended or adjusted under 35 U.S.C. 154(b) by 384 days.

(21) Appl. No.: 16/239,790

(22) Filed: Jan. 4, 2019

(65) Prior Publication Data

US 2019/0242585 A1 Aug. 8, 2019

(30) Foreign Application Priority Data

Jan. 8, 2018 (ES) ..... ES201830009

(51) Int. Cl.
*H05B 6/12* (2006.01)
*F24C 7/08* (2006.01)
*H05B 6/06* (2006.01)

(52) U.S. Cl.
CPC ..... *F24C 7/086* (2013.01); *F24C 7/083* (2013.01); *F24C 7/087* (2013.01); *H05B 6/062* (2013.01);
(Continued)

(58) Field of Classification Search
CPC ..... H05B 6/062; H05B 6/065; H05B 6/12; H05B 6/1209; H05B 6/1218; H05B 6/1245; H05B 6/1263; H05B 6/1272; H05B 6/1281; H05B 2213/03; H05B 2213/04; H05B 2213/05; H05B 2213/07;
(Continued)

(56) References Cited

U.S. PATENT DOCUMENTS

2009/0321424 A1 12/2009 Bunuel Magdalena et al.
2011/0134413 A1 6/2011 Has et al.
(Continued)

FOREIGN PATENT DOCUMENTS

DE 102015118453 A1 5/2017
EP 2043407 A1 4/2009
(Continued)

OTHER PUBLICATIONS

National Search Report EP 19 15 0138 dated Jun. 6, 2019.
National Search Report ES P 201830009 dated Sep. 28, 2018.

*Primary Examiner* — Hung D Nguyen
(74) *Attorney, Agent, or Firm* — Michael E. Tschpp; Andre Pallapies; Brandon G. Braun

(57) ABSTRACT

A hob device, in particular an induction hob device, includes a variable cooking surface, a user interface and a control unit which in the presence of a heating type divides the cooking surface into a plurality of heating zones in at least one dividing direction, associates heating parameter to each of the heating zones, in a manner dependent on location, for heating at least one cooking pot placed on the heating zone, and forms a cooking zone that is associated with the cooking pot and is heated using the heating parameter. In the event of a request of the heating type for the cooking pot, the control unit is provided to wait for at least one operating action by a user by way of the user interface.

25 Claims, 4 Drawing Sheets

(52) U.S. Cl.
CPC ..... *H05B 6/065* (2013.01); *H05B 6/1209* (2013.01); *H05B 2213/03* (2013.01); *H05B 2213/05* (2013.01); *H05B 2213/07* (2013.01)

(58) Field of Classification Search
CPC ..... F24C 7/082; F24C 7/083; F24C 7/086; F24C 7/087
USPC ..... 219/620, 621, 622, 624, 626, 662, 665, 219/671, 672, 675
See application file for complete search history.

(56) References Cited

U.S. PATENT DOCUMENTS

| | | | | |
|---|---|---|---|---|
| 2012/0043312 | A1* | 2/2012 | Lee ..... | H05B 6/062 219/622 |
| 2014/0014650 | A1* | 1/2014 | Viroli ..... | H05B 6/062 219/626 |
| 2018/0063893 | A1 | 3/2018 | Gutierrez et al. | |

FOREIGN PATENT DOCUMENTS

| | | | |
|---|---|---|---|
| EP | 3001772 | B1 | 11/2017 |
| WO | 2012026137 | A1 | 3/2012 |

* cited by examiner

HOB DEVICE

CROSS-REFERENCES TO RELATED APPLICATIONS

This application claims the priority of Spanish Patent Application, Serial No. P201830009, filed Jan. 8, 2018, pursuant to 35 U.S.C. 119(a)-(d), the disclosure of which is incorporated herein by reference in its entirety as if fully set forth herein.

BACKGROUND OF THE INVENTION

The invention relates to a hob device, to a hob, and to a method for operating a hob device.

The prior art discloses hob devices that have operating modes in which at least two operating actions are required to heat a cooking zone. Further, hob devices are known that, in one operating mode, divide a cooking surface into a plurality of heating zones that, depending on their position, define a heating power at which a cooking zone associated with a cooking pot place thereon is heated. It is known to give these hob devices a form that meets European standards, in particular EN 60335, Section 22.116, for sale in Europe. In the case of hob devices having position-dependent heating power, problems in respect of operating safety could however arise from a lack of operating actions that could serve for control by a user. Moreover, a hob device of this kind does not meet North American standards under Clause 44 of UL 858.

It would be desirable and advantageous to obviate prior art shortcomings, in particular in respect of safety.

BRIEF SUMMARY OF THE INVENTION

According to one aspect of the invention, a hob device includes a variable cooking surface, an interface, and a control unit provided in the presence of a heating type to divide the cooking surface into a plurality of heating zones in at least one dividing direction, to associate a heating parameter to each heating zone, in a manner dependent on location, for heating a cooking pot placed on the heating zone, to form a cooking zone that is associated with the cooking pot and is heated using the heating parameter, and to wait for an operating action by a user by way of the user interface, when the heating type is requested for the cooking pot.

This can in particular enhance safety. Advantageously, inadvertent changes to the heating type can be reduced. Particularly advantageously, the operating action is provided to emphasize to the user the request of the heating type. This allows the transparency of operation to be enhanced. It is conceivable for the control unit to be capable of being operated by at least one further heating type different from the heating type. Advantageously, the control unit is provided, in the event of a request of the further heating type, likewise to wait for at least one operating action by the user by way of the user interface. The term "variable cooking surface" should be understood in particular to mean a partial region of a hotplate that is provided on which to place a cooking pot in any desired way for the purpose of heating the cooking pot. In particular, the control unit is provided to form a cooking zone adapted to the cooking pot placed on the cooking surface. Preferably, the control unit is provided to form in at least one operating mode at least two, in particular at least three, advantageously at least four, preferably at least five, independent cooking zones. In particular, the variable cooking surface differs from a cooking surface whereof the cooking zones are predetermined in fixed manner, in particular by marks on the hotplate. In particular, the hob device has at least one heating element matrix and/or at least one movable heating element, in particular an induction heating element. The term "induction heating element" should be understood in particular to mean a heating element that is provided to convert at least 100 W, in particular at least 500 W, advantageously at least 1000 W, preferably at least 2000 W, of electrical heating power into an electromagnetic radiation field that preferably has a frequency of between 10 kHz and 150 kHz, in particular of between 20 kHz and 100 kHz and is provided to be converted into heat in at least one cooking pot, in particular at least the base thereof, by magnetic reversal and eddy current effects. As an alternative, resistance heaters, radiation heaters and/or similar are conceivable. The term "heating element matrix" should be understood in particular to mean a preferably two-dimensional, advantageously regular arrangement, in particular in a square or hexagonal pattern, of at least four, in particular at least ten, advantageously at least twenty, heating elements, in particular induction heating elements. The term "movable" heating element should be understood in particular to mean a heating element that is provided to be moved by at least one actuator of the variable cooking surface, within at least one partial region of the variable cooking surface. Advantageously, the hob device has at least one sensor unit that is formed in particular by the heating elements themselves and is provided to detect cooking pots placed thereon in particular by measuring at least one inductance and/or at least one capacitance. In particular, the control unit is provided to associate with a detected cooking pot a cooking zone that is adapted to a contact surface and/or position of the cooking pot. Preferably, the control unit is provided to evaluate measured values of the sensor unit, to calculate at least one cooking zone and to determine heating elements that heat this cooking zone. In particular, the control unit of the hob device is provided to control at least one power electronics unit and to set a requested heating power for a cooking zone.

The term "user interface" should be understood in particular to mean a unit that is provided for input and/or output, by and/or to a user, of at least one operating parameter, such as a heating power and/or a heating power density and/or a heating power stage and/or a heating zone and/or a heating power distribution and/or a temperature setting. The user interface could for example be provided for an optical and/or acoustic and/or touch-based output of at least one operating parameter. In particular, the user interface may have arrangements for gesture recognition. In particular, the user interface could have at least one output element by way of which the user interface could output in particular at least one operating parameter. The output element could in particular have at least one display and/or at least one light source and/or advantageously at least one liquid crystal display. For input of at least one operating parameter, the user interface could have in particular at least one input element. The input element could have for example at least one mechanical operating element, such as a joystick and/or an operating toggle and/or a rotary knob. As an alternative or in addition, the input element could have at least one touch-sensitive operating element. The output element and the input element could in particular take a form at least partly in one piece with one another, in particular in the form of a touch display.

Advantageously, the heating parameter may be set by the user. The heating parameter could in particular take the form of a heating power and/or a heating power density and/or a heating power stage and/or a temperature setting. In particular, the heating zone has a surface other than the cooking zone. The term "association in a manner dependent on location" should be understood in particular to mean an association that takes account of a position of an object. Preferably, a value of the associated heating parameter depends on the position of the object. The position may in particular take the form of an absolute position and/or a relative position. The term "absolute position" should be understood in particular to mean a position that is defined by a spacing from a reference point that is valid for all objects. The term "relative position" should be understood in particular to mean a position that is defined by a spacing from a reference point that is defined for the respective object.

The term "dividing" of the cooking surface should be understood in particular to mean that the cooking surface is split up into a plurality of partial regions that together form the entire cooking surface. In particular, the hob device may have at least two variable cooking surfaces, wherein division of the two variable cooking surfaces may be independent of one another. Advantageously, at least one of the variable cooking surfaces is divided into heating zones. The division could be performed in particular by a hardware set-up. Preferably, the division is performed by the control unit. The term "dividing direction" should be understood in particular to mean a direction perpendicular to mutually adjoining edges of two adjacent heating zones.

The term "request of a heating type" should be understood in particular to mean an action of the user that is provided to perform heating of a cooking pot using a particular heating type, in particular to activate this heating type. The term "heating type" for a cooking pot should be understood in particular to mean a manner in which a setting, in particular open-loop and/or closed-loop control, is applied to a heating power for the cooking pot. Advantageously, when the hob device is operated using the heating type, the setting, in particular open-loop and/or closed-loop control, is applied to the heating power in accordance with the heating type, for all the cooking pots placed on the cooking surface. For example, a setting could be applied to a heating power automatically by the control unit in at least one heating type for at least one cooking pot. As an alternative or in addition, a setting could be applied to a heating power manually by at least one user in at least one heating type for at least one cooking pot, in particular indirectly and/or directly. In particular, the request of the heating type may include placing a cooking pot on the variable cooking surface. Preferably, the request of the heating type includes a further operating action different from the operating action. Particularly preferably, the heating power for the cooking pot is set in the heating type in dependence on a position of the cooking pot.

The term "operating action" should be understood in particular to mean an action by the user that serves to operate the user interface. The operating action may include for example a touch on the user interface by a body part of the user and/or an acoustic input by the user and/or an operating gesture by the user. Particularly advantageously, the operating action is performed on the basis of an optical and/or acoustic and/or touch-based request that is output by way of the user interface. The request may in particular comprise information on the requested heating mode.

The term "provided" should be understood in particular to mean specifically programmed, set up and/or equipped. The expression that an object "is provided for a particular function" should be understood in particular to mean that the object fulfills and/or performs this particular function in at least one application and/or operating mode.

According to another advantageous feature of the present invention, the operating action can be a confirmation action for confirming operation of the cooking zone using the heating type. Advantageously, the operating action serves to confirm operation of all the cooking zones using the heating type. This can in particular enhance safety. Advantageously, inadvertent changes to the heating type can be reduced even further.

Moreover, it is proposed that, for setting any desired available heating type, the control unit can be provided to wait in each case for at least two mutually differing operating actions. In particular, the mutually differing operating actions include the operating action and the further operating action. Advantageously, this meets the North American standard under Clause 44 of UL 858. Particularly advantageously, this allows the control unit to be fitted with identical software for use in Europe and in North America. In particular, this can enhance cost efficiency.

Moreover, it is proposed that the control unit can be provided to interpret an activation of the cooking zone as the request of the heating type. Advantageously, the control unit can be provided to interpret at least one procedure that is involved in activating the cooking zone as the request of the heating type. The term "activation of a cooking zone" should be understood in particular to mean a procedure that is provided to switch from an unheated operating mode of the cooking zone to a heated operating mode of the cooking zone. In particular, activation of the cooking zone may include placing the cooking pot thereon. This can in particular enhance safety. Advantageously, it is possible to avoid burning the user as a result of inadvertently activating cooking zones.

Furthermore, it is proposed that activating the cooking zone can include a further operating action by the user by way of the user interface. This can further enhance operating safety. Further, it is possible in particular to enhance operating convenience and/or cost efficiency.

Moreover, it is proposed that the control unit can be provided to interpret a change in the heating type as the request of the heating type. In particular, the change in the heating type may include the further operating action. It is conceivable for the change in the heating type to include switching on the hob device. Preferably, the change in the heating type includes a change from at least one further heating type, which is in particular different from the heating type, to the heating type. This can in particular enhance operating convenience. Advantageously, the attention of the user may be drawn to the change to the heating type, in particular if the operating action is a confirmation action.

Moreover, it is proposed that the control unit can be provided, in the event of change to the heating type, to deactivate all the in particular already active cooking zones. The term "active cooking zone" should be understood in particular to mean a cooking zone that is in the heated operating mode. The term "deactivation" of a cooking zone should be understood in particular to mean a procedure that is provided to switch from the heated operating mode of the cooking zone to the unheated operating mode of the cooking zone. In particular, all the cooking zones must undergo a further activation in order to be heated in accordance with the new heating type. In particular, the deactivation of all the active cooking zones may be a response by the control unit to the operating action. It is conceivable for only individual cooking zones, in particular selected by the user, to be deactivated in the event of change to the heating type. This can in particular enhance safety and operating convenience. Advantageously, it is possible to avoid burning the user when there is a change to the heating type. Particularly advantageously, additional operating actions by the user in order to deactivate individual cooking zones are dispensed with.

Further, it is proposed that the control unit can be provided, in the event of change to the heating type, to set the heating parameter associated with the heating type set after the change, for all the active cooking zones. In particular, setting the heating parameter associated with the heating type may be a response of the control unit to the operating action. It is conceivable for the control unit, in the event of change to the heating type, to set the heating parameter associated with the heating type set after the change, only for individual cooking zones, in particular selected by the user. This can in particular enhance operating convenience. Advantageously, a change to the heating type may be undertaken for all the cooking zones at the same time, as a result of which additional operating actions by the user are dispensed with.

Further, it is proposed that the control unit can be provided, in the event of change to the heating type, to use the operating action to select either to deactivate all the active cooking zones or to set the heating parameter associated with the heating type set after the change, for all the active cooking zones. In particular, the control unit is provided to give the user the possibility of selection using the user interface, at least for the two variants mentioned. It is conceivable for the control unit to set the heating parameter associated with the heating type set after the change, only for individual cooking zones, in particular selected by the user, and/or to deactivate only individual cooking zones, in particular selected by the user. This can enhance flexibility.

Further, it is proposed that the control unit can be provided to use the heating type as standard as desired by the user. The term "standard" should be understood in particular to mean a heating type that is set automatically when the hob device is switched on. It is conceivable for the standard to be selectable from a plurality of heating types, in particular by the user. This can in particular enhance operating convenience. In particular, operating actions by the user for changing the heating type are dispensed with.

Moreover, it is proposed that the control unit can be provided, in the event of an absence of the cooking pot lasting at least 10 seconds, advantageously at least 15 seconds, particularly advantageously at least 20 seconds, preferably at least 25 seconds and particularly preferably at least 30 seconds, to deactivate the cooking zone associated with the cooking pot. The term "absence of the cooking pot" should be understood in particular to mean a time period in which the cooking pot is not located on the cooking surface, in particular after it has previously been removed from the cooking surface. This can in particular enhance safety. Advantageously, it is possible to avoid burning the user as a result of touching heated cooking zones where there is no cooking pot.

According to another aspect of the present invention, a hob includes a hob device according to the invention. This can in particular enhance safety and cost efficiency.

According to still another aspect of the present invention, a method for operating a hob device includes in the presence of a heating type, dividing a variable cooking surface of the hob device into a plurality of heating zones in at least one dividing direction, associating a heating parameter to each heating zone, in a manner dependent on location, for heating a cooking pot placed on the heating zone, forming a cooking zone that is associated with the cooking pot and heated using the heating parameter, and waiting for an operating action by a user by way of an user interface of the hob device, when the heating type is requested for the cooking pot.

In accordance with the present invention, in the event of a request of the heating type for the cooking pot, it is proposed to wait for at least one operating action by a user by way of the user interface. This can in particular enhance safety and cost efficiency.

BRIEF DESCRIPTION OF THE DRAWINGS

Further advantages will be apparent from the description of the drawing below. The drawings illustrate an exemplary embodiment of the invention. The drawings, descriptions and claims contain numerous features in combination. Those skilled in the art will favorably also consider the features individually and combine them to give useful further combinations.

In the drawings.

DETAILED DESCRIPTION OF EXEMPLARY EMBODIMENTS OF THE PRESENT INVENTION

Figure 1:
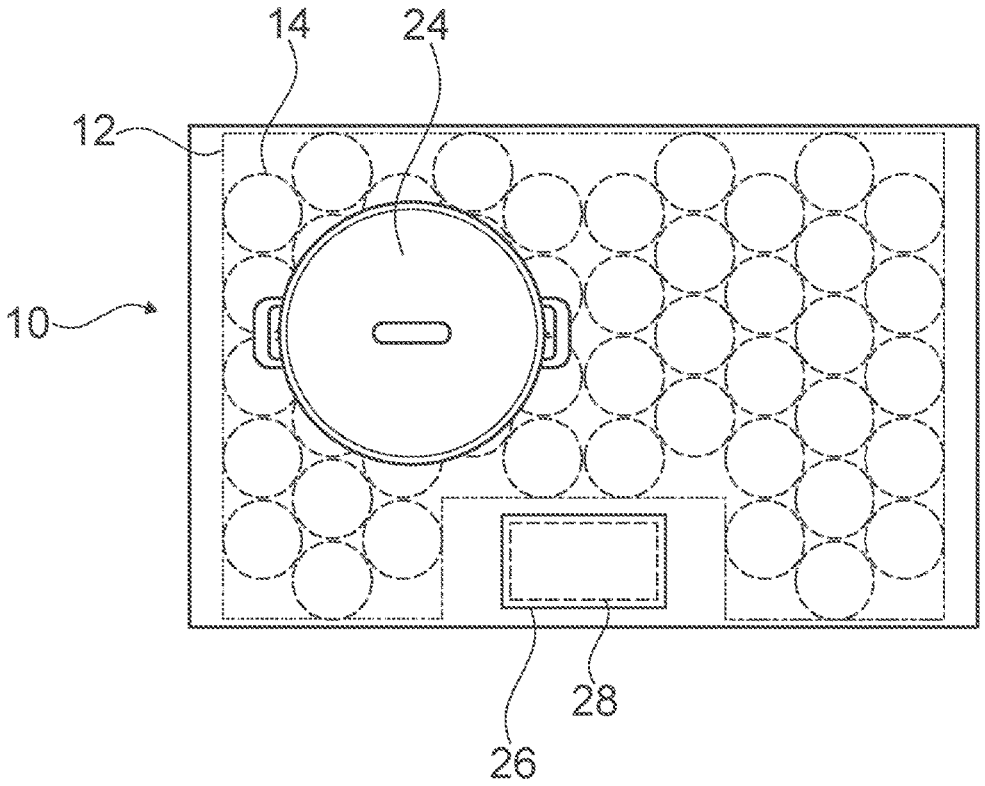
FIG. 1 shows a hob having a hob device that has a user interface.

FIG. 1 shows a hob 10. The hob 10 may in particular take the form of an induction hob. The hob 10 has a hob device. The hob device may in particular take the form of an induction hob device.

The hob device has a variable cooking surface 12. Placed on the cooking surface 12 is a cooking pot 24. The hob device has heating elements 14. The heating elements 14 are provided for heating the cooking pot 24 placed on the cooking surface 12. The heating elements 14 are identical to one another in form. The heating elements 14 are arranged in a matrix shape.

The hob device has a sensor unit (not illustrated). The sensor unit extends over the entire cooking surface 12. The sensor unit is provided to detect a contact surface and a position of the placed-on cooking pot 24. The sensor unit has the heating elements 14, which are used in known manner as inductive sensors to detect the cooking pot 24. As an alternative, the sensor unit could also have capacitive sensors.

The hob device has a user interface 26 for communication with a user. The user interface 26 has a touch display. As an alternative, the user interface 26 could have press buttons and/or arrangements for gesture recognition. The user interface 26 is provided for the input and output of heating parameters.

The hob device has a control unit 28. The control unit 28 is operatively connected to the user interface 26. The control unit 28 is operatively connected to the sensor unit. Depending on the contact surface of the cooking pot 24 that is detected by the sensor unit, in at least one operating mode the control unit 28 forms a cooking zone 16 that is associated with the cooking pot 24. For this purpose, the control unit 28 groups together all the heating elements 14 that are located below the contact surface to form the cooking zone 16. The control unit 28 is provided, in the event of an absence of the cooking pot 24 lasting at least 10 seconds, to deactivate the cooking zone 16 associated with the cooking pot 24.

The hob 10 can be operated in at least one heating type, for example in a heating type designated "power move". In the heating type, the control unit 28 is provided to divide the cooking surface 12 into a plurality of heating zones (not illustrated) in a dividing direction parallel to a depth direction of the cooking surface 12 and to associate with these heating zones, in a manner dependent on location, in each case at least one heating parameter for heating the cooking pot 24 by the cooking zone 16.

Further, the hob 10 may be operated in at least one additional heating type, for example an additional heating type designated "professional mode". The additional heating type differs from the heating type in that the dividing direction runs parallel to a width direction of the cooking surface 12.

Moreover, the hob 10 may be operated in a further heating type, for example a further heating type designated "classic mode". In the further heating type, the user sets a further heating parameter for the cooking zone 16 by way of the user interface 26. To set the further heating parameter for the cooking zone 16, the user touches an image that corresponds to the cooking zone 16 and is output by the user interface 26. Then, the user interface 26 displays a list of available heating parameters. By touching one of the available heating parameters, the user sets this available heating parameter for the cooking zone 16. The control unit 28 is provided to enable all the heating types to be set as standard and to be used as desired by the user.

Figure 2:
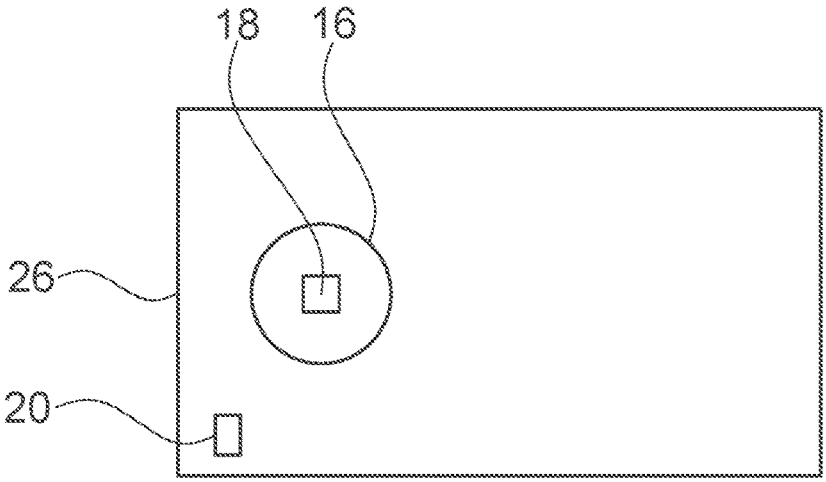
FIG. 2 shows the user interface in a first condition.

FIG. 2 shows the user interface 26 in at least one operating mode. The user interface 26 shows an image of the cooking zone 16. In the present case, the hob 10 is operated in the further heating type. The further heating parameter that is used to heat the cooking zone 16 is represented by a heating stage field 18. The heating stage field 18 is displayed by the user interface 26.

The control unit 28 is provided, in the event of a request of the heating type and/or the additional heating type for the cooking pot 24, to wait for at least one operating action by a user by way of the user interface 26. The request of the heating type and/or the additional heating type includes a further operating action by the user. The control unit 28 is provided, for setting an available heating type, to wait in each case for at least two mutually differing operating actions. The control unit 28 is provided to interpret a change to the heating type and/or the additional heating type as the request of the heating type. For the change to the heating type and/or the additional heating type, in the further operating action the user actuates a switch surface 20 of the user interface 26.

Figure 3:
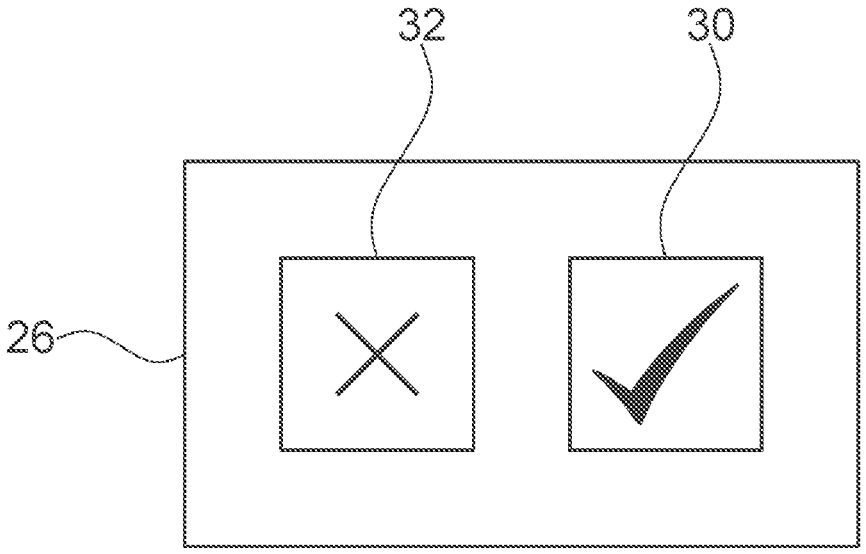
FIG. 3 shows the user interface in a second condition.

FIG. 3 shows the user interface 26 after the further operating action. The user interface 26 shows a confirmation switch 30 and a cancelation switch 32. As an alternative, the user interface 26 could output additional optical, acoustic or touch-based signals. The control unit 28 is provided, in the event of change to the heating type and/or the additional heating type, to use the user interface to select either to deactivate all the already active cooking zones 16, or to set the heating parameter associated with the heating type and/or the additional heating type, for all the already active cooking zones 16. If the cancelation switch 32 is actuated, the control unit 28 is provided, in the event of change to the heating type and/or the additional heating type, to deactivate all the already active cooking zones 16. If the confirmation switch 30 is actuated, the control unit 28 is provided, in the event of change to the heating type and/or the additional heating type, to set the heating parameter associated with the heating type and/or the additional heating type, for all the already active cooking zones 16. Actuation of the confirmation switch 30 and actuation of the cancelation switch 32 correspond to the operating action. After the operating action, the change to the heating type and/or the additional heating type is performed by the control unit 28.

Figure 4:
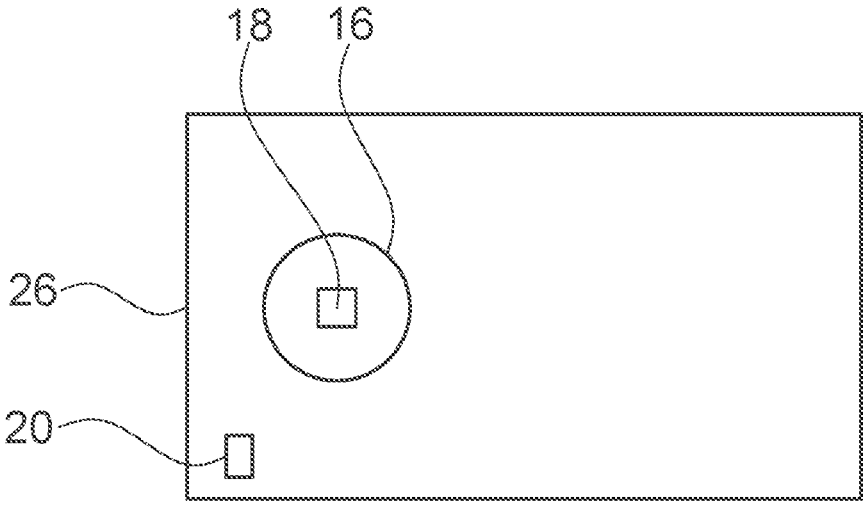
FIG. 4 shows the user interface in a third condition.

FIG. 4 shows the user interface 26 after the change to the heating type and/or the additional heating type if the confirmation switch 30 is actuated. The heating parameter that is used to heat the cooking zone 16 is represented by the heating stage field 18.

Figure 5:
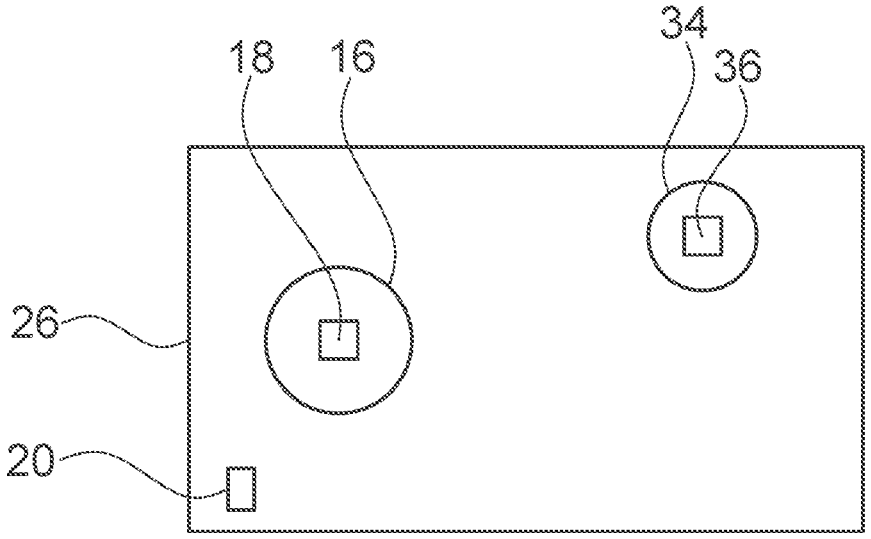
FIG. 5 shows the user interface in a fourth condition.

FIG. 5 shows the user interface 26 after a further cooking pot (not illustrated) has been placed on the cooking surface 12. The user interface 26 shows an image of a further cooking zone 34 that is associated with the further cooking pot. In the present case, the cooking zone 34 is still inactive. The user interface 26 indicates this by a symbol 36. A request to activate the cooking zone 34 takes the form of the further operating action by the user by way of the user interface 26. In the further operating action, the user actuates the image of the cooking zone 34. The control unit 28 is provided to interpret the request to activate the cooking zone 34 as the request of the heating type and/or the additional heating type. In a manner analogous to FIG. 3, after the further operating action the user interface 26 shows the confirmation switch 30 and the cancelation switch 32. Actuation of the confirmation switch 30 and actuation of the cancelation switch 32 each correspond to the operating action. If the confirmation switch 30 is actuated, the control unit 28 is provided to perform activation of the cooking zone 34. The operating action corresponds to a confirmation action to confirm operation of the cooking zone 34 with the heating type and/or the additional heating type. If the cancelation switch 32 is actuated, activation of the cooking zone 34 is canceled. For activation of the cooking zone 34, the further operating action must then be performed again.

Figure 6:
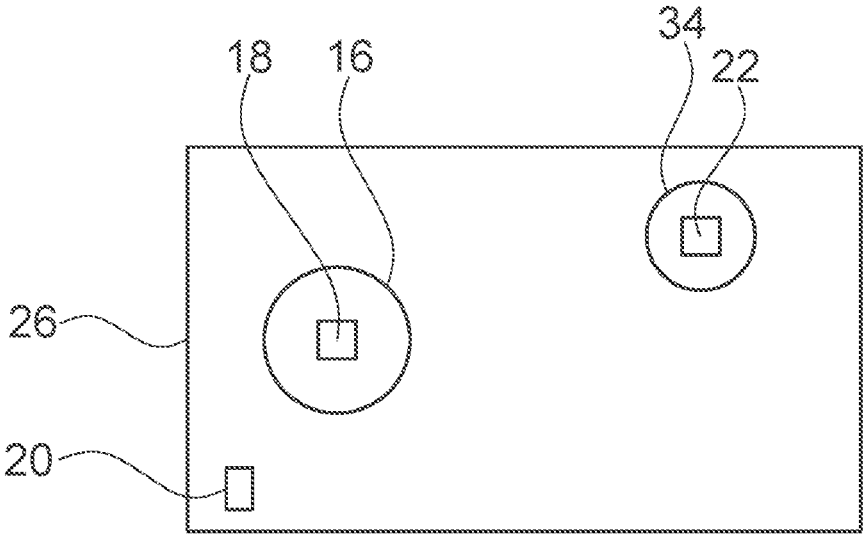
FIG. 6 shows the user interface in a fifth condition.

FIG. 6 shows the user interface 26 after the confirmation action to confirm operation of the cooking zone 34 with the heating type and/or the additional heating type. The heating parameter associated with the further cooking pot is represented by a further heating stage field 22.

Figure 7:
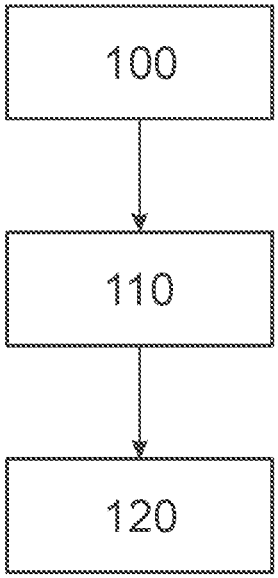
FIG. 7 shows a schematic method chart for operation of the hob device.

FIG. 7 shows a schematic method chart for operation of the hob device. In a method step 100, the user makes a request of the heating type and/or the additional heating type for the cooking pot 24. The request of the heating type and/or the additional heating type is performed through the further operating action by way of the user interface 26. In a further method step 110, the user performs the operating action by way of the user interface 26. The further method step 110 follows the method step 100. In a further method step 120, the control unit 28 applies a setting that is matched to the further operating action. The further method step 120 follows the further method step 110.

What is claimed is:

1. A hob device, comprising:

a variable cooking surface;

a user interface; and a control unit configured to:

determine, in response to sensing a user operation, a first heating mode type of the variable cooking surface, the first heating mode type corresponding to a first spatial division of the variable cooking surface into two or more first heating zones, each of the first heating zones having a respective first heating parameter;

in response to sensing a cooking pot on the variable cooking surface, identify a cooking zone comprising a plurality of heating elements disposed underneath the cooking pot; and in response to receiving a user confirmation via the user interface, control the plurality of heating elements of the cooking zone based on the first heating parameter associated with the first heating zone corresponding to a location of the cooking zone on the variable cooking surface;

wherein the control unit is configured to refrain from activating the plurality of heating elements until the user operation is sensed and the user confirmation is received.

2. The hob device of claim 1, wherein the hob device comprises an induction hob device.

3. The hob device of claim 1, wherein receiving the user confirmation includes receiving a confirmation input via a confirmation switch of the user interface.

4. The hob device of claim 1, wherein sensing the user operation comprises sensing the cooking pot on the variable cooking surface.

5. The hob device of claim 1, wherein sensing the user operation comprises sensing the cooking pot on the variable cooking surface and receiving an operating input via the user interface.

6. The hob device of claim 1, wherein sensing the user operation comprises receiving a selection of the first heating mode type from a plurality of available heating mode types via the user interface.

7. The hob device of claim 1, wherein the control unit is configured to, in response to receiving a user input requesting to change from the first heating mode type to a second heating mode type corresponding to a second spatial division of the variable cooking surface into two or more second heating zones, each of the second heating zones having a respective second heating parameter:

control heating elements of each of one or more active cooking zones based on the respective second heating parameters associated with the second heating zones corresponding to respective locations of the active cooking zones on the variable cooking surface.

8. The hob device of claim 1, wherein the control unit is configured to, in response to receiving a user input requesting to change from the first heating mode type to a second heating mode type corresponding to a second spatial division of the variable cooking surface into two or more second heating zones, prompt a user via the user interface to select either:

a first option, in response to which the control unit is configured to deactivate all active cooking zones, or a second option, in response to which the control unit is configured to control heating elements of each of one or more active cooking zones based on a second heating parameter associated with the second heating zone corresponding to a respective location of the active cooking zone on the variable cooking surface.

9. The hob device of claim 1, wherein a memory of the control unit is configured to store a default heating mode type, and wherein determining the first heating mode type in response to sensing the user operation comprises identifying the stored default heating mode type in response to a user switching on the hob device.

10. The hob device of claim 1, wherein the control unit is configured to deactivate the cooking zone in response to sensing an absence of the cooking pot lasting at least 10 seconds.

11. The hob device of claim 1, wherein at least a portion of the first heating zone corresponding to the location of the cooking zone is not included in the cooking zone.

12. The hob device of claim 1, wherein the cooking pot is a first cooking pot and the cooking zone is a first cooking zone, and wherein the control unit is further configured to:

in response to sensing a second cooking pot on the variable cooking surface, identify a second cooking zone comprising a plurality of heating elements disposed underneath the second cooking pot;

receive, via the user interface, a user instruction to activate the second cooking zone; and in response to receiving a second user confirmation, control the plurality of heating elements of the second cooking zone based on the first heating parameter associated with the first heating zone corresponding to a location of the second cooking zone on the variable cooking surface.

13. The hob device of claim 1, wherein each of the two or more first heating zones extend parallel to each other in a depth direction of the variable cooking surface.

14. A hob comprising a hob device, the hob device comprising:

a variable cooking surface, a user interface, and a control unit configured to:

determine, in response to sensing a user operation, a first heating mode type of the variable cooking surface, the first heating mode type corresponding to a first spatial division of the variable cooking surface into two or more first heating zones, each of the first heating zones having a respective first heating parameter;

in response to sensing a cooking pot on the variable cooking surface, identify a cooking zone comprising a plurality of heating elements disposed underneath the cooking pot; and in response to receiving a user confirmation via the user interface, control the plurality of heating elements of the cooking zone based on the first heating parameter associated with the first heating zone corresponding to a location of the cooking zone on the variable cooking surface;

wherein the control unit is configured to refrain from activating the plurality of heating elements until the user operation is sensed and the user confirmation is received.

15. A method for operating a hob device, comprising:

determining, in response to sensing a user operation, a first heating mode type of a variable cooking surface of the hob device, the first heating mode type corresponding to a first spatial division of the variable cooking surface into two or more first heating zones, each of the first heating zones having a respective first heating parameter;

in response to sensing a cooking pot on the variable cooking surface, identifying a cooking zone comprising a plurality of heating elements disposed underneath the cooking pot; and in response to receiving a user confirmation via a user interface after sensing the user operation, controlling the plurality of heating elements of the cooking zone based on the first heating parameter associated with the first heating zone corresponding to a location of the cooking zone on the variable cooking surface.

16. The method of claim 15, wherein the heating elements comprise induction heating elements.

17. The method of claim 15, wherein receiving the user confirmation includes receiving a confirmation input via a confirmation switch of the user interface.

18. The method of claim 15, wherein sensing the user operation comprises sensing the cooking pot on the variable cooking surface.

19. The method of claim 15, wherein sensing the user operation comprises sensing the cooking pot on the variable cooking surface and receiving an operating input via the user interface.

20. The method of claim 15, wherein sensing the user operation comprises receiving a selection of the first heating mode type from a plurality of available heating mode types via the user interface.

21. The method of claim 15, further comprising, in response to receiving a user input requesting to change from the first heating mode type to a second heating mode type corresponding to a second spatial division of the variable cooking surface into two or more second heating zones, each of the second heating zones having a respective second heating parameter:

controlling heating elements of each of one or more active cooking zones based on the respective second heating parameters associated with the second heating zones corresponding to respective locations of the active cooking zones on the variable cooking surface.

22. The method of claim 15, further comprising, in response to receiving a user input requesting to change from the first heating mode type to a second heating mode type corresponding to a second spatial division of the variable cooking surface into two or more second heating zones:

receiving a user selection via the user interface; and based on the user selection, either:

deactivating all active cooking zones, or controlling heating elements of each of one or more active cooking zones based on a second heating parameter associated with the second heating zone corresponding to a respective location of the active cooking zone on the variable cooking surface.

23. The method of claim 15, wherein determining the first heating mode type in response to sensing the user operation comprises identifying a default heating mode type stored in a memory of the hob device in response to a user switching on the hob device.

24. The method of claim 15, further comprising deactivating the cooking zone in response to sensing an absence of the cooking pot lasting at least 10 seconds.

25. The method of claim 15, wherein at least a portion of the first heating zone corresponding to the location of the cooking zone is not included in the cooking zone.

* * * * *